US010940078B1

(12) United States Patent
Lee

(10) Patent No.: US 10,940,078 B1
(45) Date of Patent: Mar. 9, 2021

(54) VIBRATORY MASSAGE APPARATUS

(71) Applicant: AMERICAN LATEX CORP., Chatsworth, CA (US)

(72) Inventor: Calvin Spencer Lee, Chatsworth, CA (US)

(73) Assignee: AMERICAN LATEX CORP., Chatsworth, CA (US)

( * ) Notice: Subject to any disclaimer, the term of this patent is extended or adjusted under 35 U.S.C. 154(b) by 0 days.

(21) Appl. No.: 17/008,596

(22) Filed: Aug. 31, 2020

(51) Int. Cl.
*A61H 19/00* (2006.01)

(52) U.S. Cl.
CPC ..... *A61H 19/34* (2013.01); *A61H 19/32* (2013.01); *A61H 19/50* (2013.01); *A61H 2201/01* (2013.01); *A61H 2201/165* (2013.01); *A61H 2201/1654* (2013.01)

(58) Field of Classification Search
CPC ..... A61H 19/00; A61H 19/30; A61H 19/32; A61H 19/34; A61H 19/50
USPC ..... 600/38
See application file for complete search history.

(56) References Cited

U.S. PATENT DOCUMENTS

| | | | |
|---|---|---|---|
| 3,478,736 | A | 11/1969 | Roberts et al. |
| 6,454,236 | B2 | 9/2002 | Garaud et al. |
| 8,579,837 | B1 | 11/2013 | Makower et al. |
| 10,206,557 | B2 | 2/2019 | Wilson |
| 10,524,977 | B2 | 1/2020 | Lee |
| 2001/0020667 | A1 | 9/2001 | Garaud et al. |
| 2013/0060081 | A1 | 3/2013 | Carter et al. |
| 2014/0357949 | A1 | 12/2014 | Wilson |
| 2016/0151236 | A1 | 6/2016 | Makower et al. |
| 2018/0185237 | A1* | 7/2018 | Baetica ..... G08C 17/02 |

FOREIGN PATENT DOCUMENTS

| | | | |
|---|---|---|---|
| EP | 2783673 | A1 | 10/2014 |
| FR | 2992550 | A1 | 1/2014 |
| WO | 2012071309 | A1 | 5/2012 |
| WO | 2017173670 | A1 | 10/2017 |

* cited by examiner

*Primary Examiner* — John P Lacyk
(74) *Attorney, Agent, or Firm* — Danton Mak; Leech Tishman Fuscaldo & Lampl

(57) ABSTRACT

The invention provides a vibration massage apparatus wherein one or more vibrators which can be housed in rigid elongate capsules are supported by respective pairs of flexible members relative to a main body that can serve as a handle and/or a relatively non vibrational flesh-contacting surface, thus having a wide range of application and significantly optimizing user experience.

20 Claims, 4 Drawing Sheets

17
15
17
15'
17'
11''', 12''', 16''
28
26B
26A
54
10'''
13''

17
15
G1
14
17
14'
15'
G2
17'
11''', 12''', 16''
28
24
20
26B
26A
50'
10'''
23
22
22
23

VIBRATORY MASSAGE APPARATUS

FIELD OF THE INVENTION

The invention relates to the field of vibratory massagers and, in particular, to both general and sexually stimulative vibratory massagers.

BACKGROUND OF THE INVENTION

Conventional vibratory massagers include a main body enclosing at least one vibratory element, such as a motor having an eccentric weight on its armature shaft. The motor and eccentric weight are often in a hard housing such as ABS plastic, the combination of the motor, eccentric weight, and housing forming the vibratory element, commonly referred to as a "bullet." The main body may be formed for contacting external and/or internal surfaces of a user, typically being shaped as an elongated rod with the vibratory element being located near one end, an opposite end portion containing suitable electronics (such as a controller and rechargeable battery) and serving as a handle.

One problem with vibratory massagers of the prior art is unwanted discomfort resulting from vibrations transmitted to handle portions of such massagers. Vibrations transmitted to the handle results in the user having to grasp or manipulate a strongly vibrating article, which can be uncomfortable or even unsafe. Another problem is that vibrations are insufficiently localized as may be desired. Further, such massagers are unnecessarily loud and inefficient in that energy is wasted in vibrations of the main body. Wasted vibrations produce shorter battery life, louder motor noises, etc.

U.S. Pat. No. 10,524,977 discloses stimulation devices in which a distal portion is flexibly elastically connected to a base portion. Although some vibration isolation is obtained, there is an undesirable trade-off between the degree of isolation and a desired amount of pressure that can be applied to the user.

Therefore, there is a need for a vibratory massaging apparatus that overcomes at least some of the above disadvantages exhibited in the prior art.

SUMMARY OF THE INVENTION

The present invention meets this need by providing a vibratory massage apparatus wherein an included vibrator is more effectively isolated from a main body of the massage apparatus than is exhibited in massagers of the prior art. In one aspect of the invention, the vibratory massage apparatus includes a body member having a main portion and a handle portion that may overlap the main portion; a vibrator; a plurality of flexible members connected between the vibrator and the main portion of the body member for resiliently supporting the vibrator relative to the main portion of the body member and providing vibration isolation, the flexible members extending in different directions from the vibrator, the body member being formed of a flexible material, a vibrating element section thereof at least partially enclosing the vibrator, flexible arm portions of the body member forming the flexible members. Preferably, a pair of the flexible arm portions extend oppositely from the vibrator. More preferably, the vibrator is elongate, the pair of flexible arm portions extending from opposite ends of the vibrator. It will be understood that the flexible arm portions extending in different directions is inclusive of extending in parallel from different locations along the vibrator.

Preferably, the main portion and the vibrating element section of the body member are adapted for simultaneously contacting a user's anatomy. Preferably, a casing is at least partially enclosed within the body member, a control module, being located inside the casing for driving the vibrator, the casing being formed of a rigid material and defining an extent of the main portion of the body member. As used herein, a flexible material is relatively flexible (silicone, for example), and a rigid material is relatively rigid (ABS, for example). Also, a battery and a charging unit for the battery can also be enclosed within the casing, the battery being connected for powering the vibrator and the control module, the charging unit being adapted for receiving power from an external power source. Further, at least one control key can be located on the body.

The vibratory massage apparatus can have an opening extending through the handle portion of the body member for receiving a bodily appendage of the user or a partner of the user.

In another aspect of the invention, the vibratory massage apparatus includes the flexible body member having the main portion and the handle portion that may overlap the main portion of the body member; a spine member at least partially enclosed by the body member; and a vibrator at least partially enclosed by the body member; the plurality of flexible members being connected between the vibrator and the spine member and extending in different directions from the vibrator, the flexible members being formed by flexible arm portions of the body member, the flexible members resiliently supporting the vibrator relative to the spine member for vibration isolation, such that portions of the body member enclosing the spine member and the vibrator are adapted for simultaneously contacting a user's anatomy. Preferably, the vibrator is elongate, the flexible arm portions extending from opposite ends of the vibrator. More preferably, the flexible arm portions are integrally formed with the body member, the spine member being inflexible relative to the flexible arm members.

The vibrator can be a first vibrator, the vibratory massage apparatus further including a second vibrator and corresponding flexible arm portions connecting the second vibrator to the spine member. Preferably, the first and second vibrators are axially disposed along the spine member and oriented on opposite sides of the spine member. Moreover, the spine member is preferably sinuous in shape. As used herein, sinuous in shape means having axially disposed curves in opposite directions.

In another variation, the second vibrator is inclined relative to the spine member and on the same side of the spine member as the first vibrator. Further, the second vibrator can be smaller than the first vibrator.

Preferably the vibratory massage apparatus further includes a control module, a battery, and a charging unit for the battery, located inside the spine member, the battery being connected for powering the vibrator and the control module, and the charging unit being adapted for receiving power from an external power source.

Preferably, a control key is located on the housing, the control key being connected to the control module; at least one output control mode being stored in the control module; and the control module is configured for selectively activating or turning off the vibrator, and setting an output control mode in response to a user's control key operation.

In a further aspect of the present invention, a method for massaging a user includes the steps of: (a) providing (i) a body member having a main portion and a handle portion that may overlap the main portion; (ii) a vibrator; and (iii)

vibration isolation means for resiliently supporting the vibrator relative to the main portion of the body member, the vibration isolation means comprising a plurality of flexible members connected between the vibrator and the main portion of the body member, the flexible members extending in different directions from the vibrator, wherein the body member comprises a flexible material, a vibrating element section thereof at least partially enclosing the vibrator, flexible arm portions thereof forming the flexible members; (b) manipulating the vibrating element section of the vibrator into contact with an anatomy portion of the user; (c) activating the vibrator; and (d) further manipulating the handle portion of the body member for varying contact pressure between the vibrating element section and the user's anatomy. The method can include the further step of manipulating the handle portion for simultaneously massaging a different anatomy portion of the user with the main portion of the body member. The method can include the further steps of: (a) providing an opening through the handle portion of the body member; and (b) wherein the step of manipulating the handle portion includes inserting a bodily appendage of the user or a partner of the user through the opening.

The vibration massage apparatus of present invention thus provides numerous advantages in that smaller, quieter motors produce given levels of stimulation, or same sized motors provide stronger concentrated vibrations felt by the user. Also, simultaneous vibratory and non-vibratory massaging is provided, wherein there is no need to handle a strongly vibrating article, as rigid portions of the massager are not being strongly vibrated, and the gap between the suspended vibrator allows forced deformation of the flexible members (by applying lateral pressure), which in turn allows the vibrator to be resiliently pressed into the user's body surface being stimulated, the flexible members returning to initial undeformed conditions when the lateral pressure is released.

BRIEF DESCRIPTION OF THE ACCOMPANYING DRAWINGS

These and other features, aspects, and advantages of the present invention will become better understood with reference to the following description, appended claims, and accompanying drawings, where:

LIST OF REFERENCE SIGNS

D. diameter; G, G1, G2. gap; T. thickness; W. width; 10, 10', 10", 10'''. vibratory massage apparatus; 11, 11', 11", 11'''. body; 12, 12', 12", 12'''. main body portion; 13, 13', 13". handle portion; 14. vibrator; 15, 15', 15A, 15B. vibrating element section; 16, 16', 16A, 16B, 16C. sleeve; 17, 17'. flexible arm portion; 18, 18'. casing; 20. battery; 22. charging unit; 23. charging port; 24. control module; 26. button switch; 26A. power switch; 26B. mode switch; 28. LED indicator; 30. motor; 31. Locating rib; 32. eccentric weight; 33. retainer rib; 34. housing; 34A. motor end portion; 34B. opposite end portion; 36. cavity; 38. insert member; 40. opening; 50, 50A, 50B. spine member; 51. screw counterbore; 52. cap; 53. groove; 54. decorative ring.

DETAILED DESCRIPTION OF THE PREFERRED EMBODIMENTS

Figure 1:
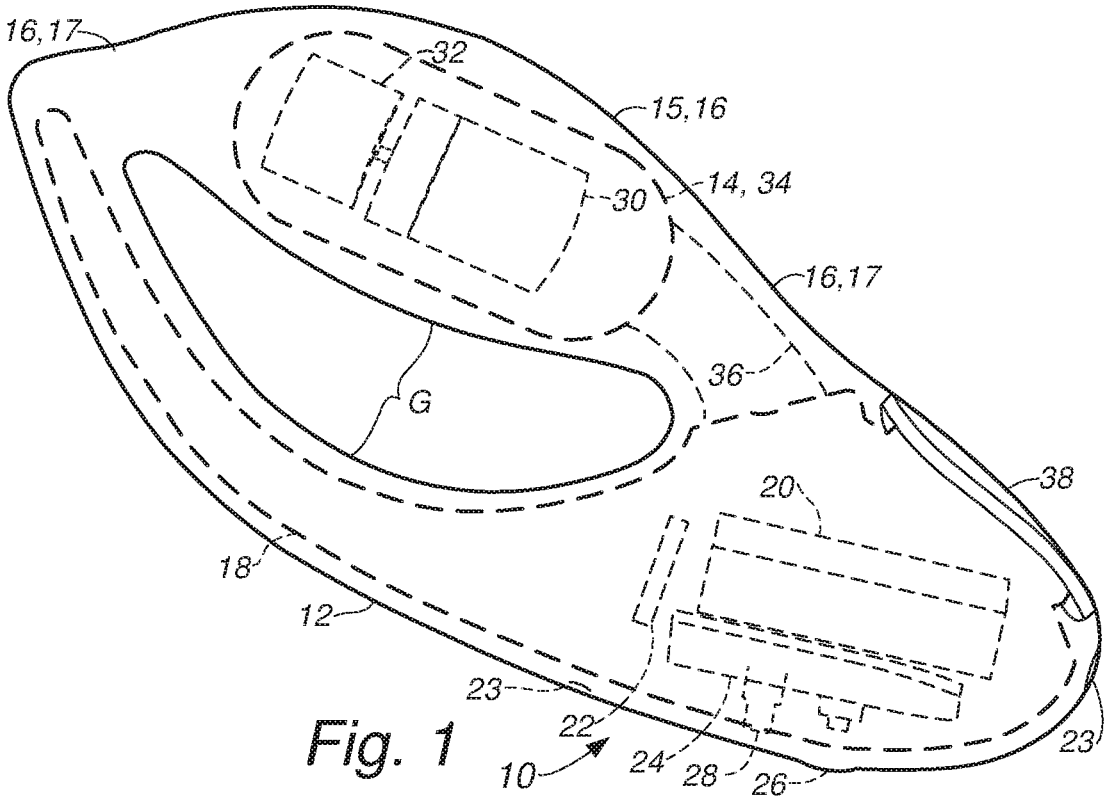
FIG. 1 is a plan view of a vibratory massage apparatus according to the present invention.
Figure 3:
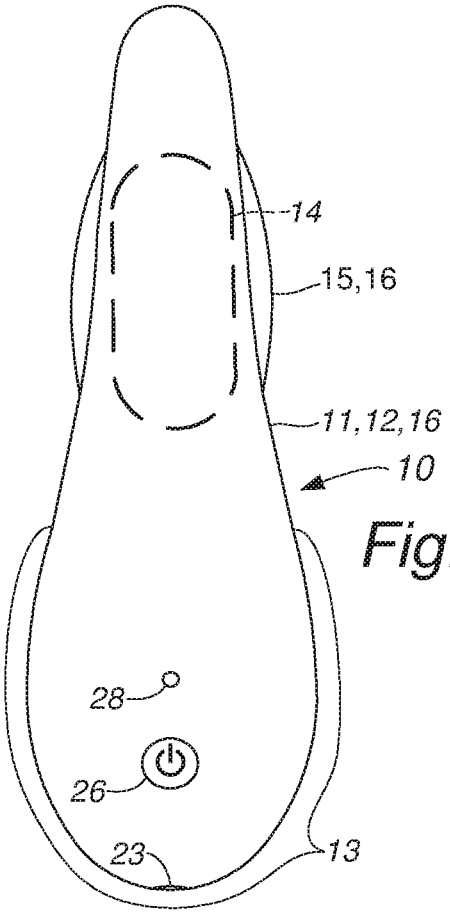
FIG. 3 is a side view of the massage apparatus of FIG. 1.
Figure 2:
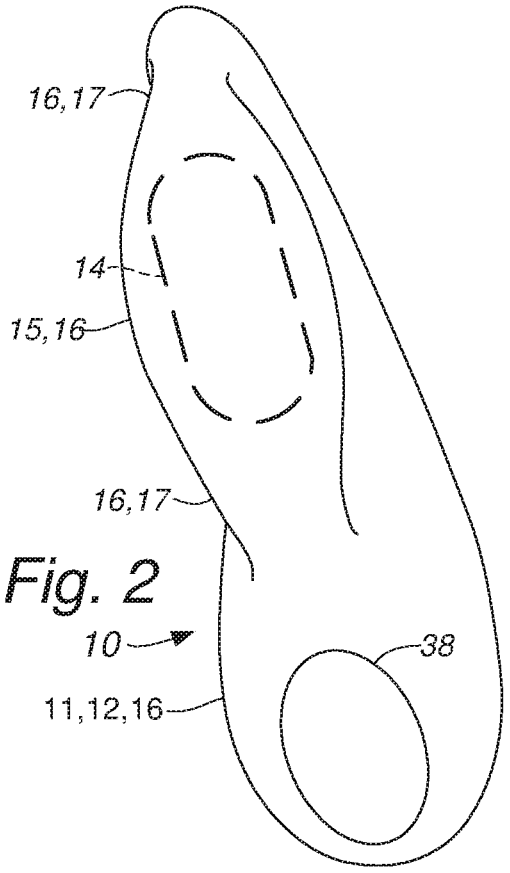
FIG. 2 is an oblique perspective view of the massage apparatus of FIG. 1.

The present invention is directed to a vibratory massager exhibiting enhanced isolation between one or more vibrators and other parts of the massager, while permitting intensified stimulation felt by the user from the application of lateral force by manipulation of a rigid portion of the massager. With reference to FIGS. 1-3 of the drawings, a vibratory massager 10 includes a body 11 having a main body portion 12 including a handle portion 13, a vibrator 14, and a flexible sleeve 16 that encloses the vibrator 14 and forms an outer portion of the main body 12. The portion of the sleeve 16 enclosing the vibrator 14 is designated vibrating element section 15, a gap G being formed between the vibrating element section 15 and the main body portion 12. Supported within the main body portion 12 is a housing or casing 18 containing a suitable power source for the vibrator 14, which may include a battery 20 such as a lithium battery, electronics such as a charging unit 22 having a charging port 23 for the battery 20, and a control module 24. The charging port 23 can include a conventional removable or tethered sealing cap. It will be understood that wireless means for charging the battery 20 is within the scope of the present invention. A user-operable button switch 26, and an LED indicator 28 are exposed on the main body 12 and connected to the control module 24, the button switch activating and setting mode(s) of operation of the massager 10. It will be understood that remote means such as Wi-Fi or Bluetooth communicating with the control module 24 can be substituted for the button switch 26. It will be further understood that the casing 18 is formed of a relatively rigid material such as ABS for defining the extent of the main body 12.

As further shown in FIG. 1, the vibrator 14 may include a motor 30 for rotating an eccentric weight 32 having suitable mass. The motor 30 and the eccentric weight 32 are enclosed in an elongate cylindrical (bullet-shaped) housing 34 having rounded ends and formed of a substantially rigid material such as ABS. The sleeve 16 preferably extends longitudinally from opposite ends of the housing 34, being anchored thereto by the vibrating element section 15 enclosing the vibrator 14, the sleeve 16 forming a pair of flexible arm portions 17 between the vibrator 14 and the main body portion 12, the sleeve 16 being formed of a suitable flexible material such as silicone. It will be understood that more than two of the flexible arm portions 17 are within the scope of the present invention. Thus the vibrator 14 is suspended between at least two flexible arm portions 17, the vibration isolation being enhanced to the extent of the length, thinness, and softness of the flexible arm portion material.

Figure 8:
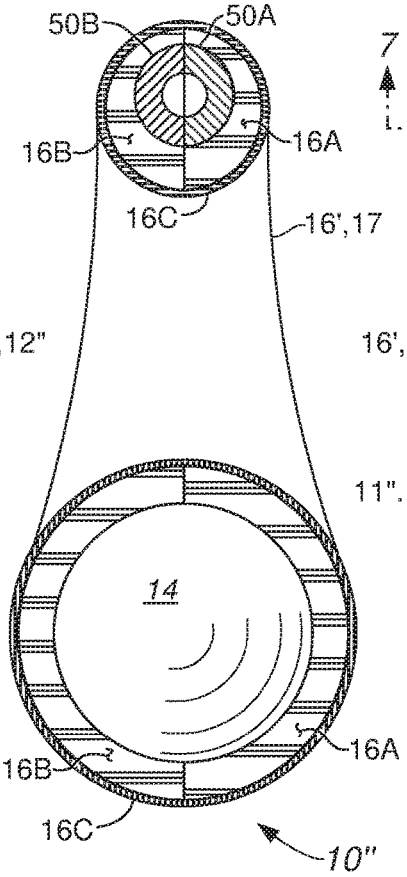
FIG. 8 is a sectional view on line 7-7 in FIG. 6 of the vibratory massage apparatus of FIG. 5.

A cavity 36 is formed within one of the flexible arm portions 17, for providing a wiring channel between the vibrator 14 and the casing 18 (suitable wiring being not shown), and for enhanced flexibility of that flexible arm portion 17. It will be understood that each of the flexible arm portions 17 can be hollow for increased flexibility. The sleeve 16 can be formed of an outer sleeve portion and opposite inner sleeve portions for facilitating assembly with the vibrator 14, the outer sleeve portion securing the inner sleeve portions about the vibrator 14 as shown in FIG. 8 and further described below.

Alternatively, the sleeve 16 can be a single flexible member that encapsulates the vibrator 14 and at least a portion of the casing 18. As further shown in FIGS. 1 and 2, an insert member 38 is removably imbedded in the sleeve 16 proximate the casing 18 for providing an opening through which the vibrator 14 and the casing 18 can be inserted into the sleeve 16, the cavity 36 providing a passage for inserting the vibrator 14 into the vibrating element section 15. The insert member 38 can be formed of a relatively rigid material such as ABS or a flexible material such as silicone.

Figure 4:
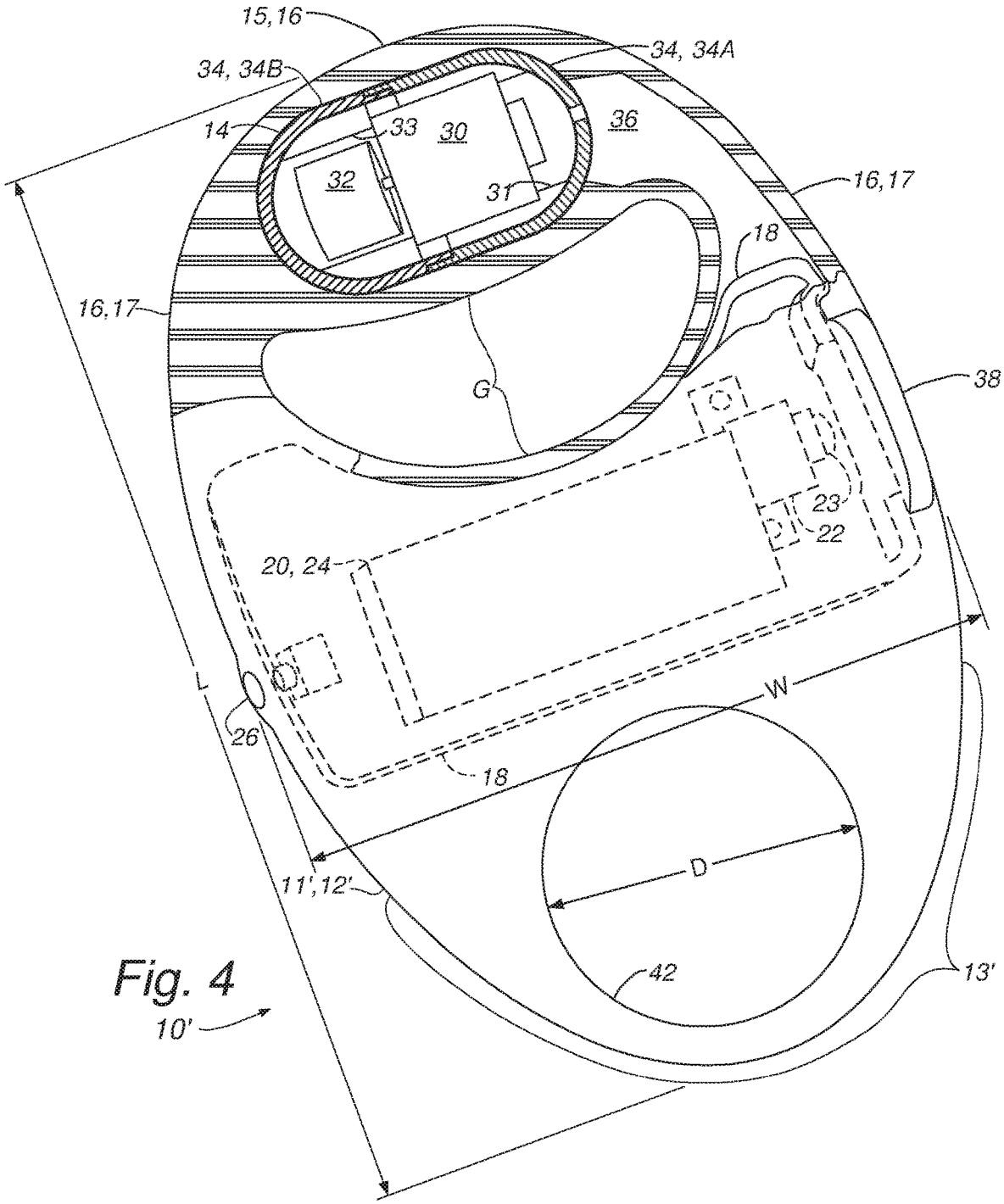
FIG. 4 is a fragmentary sectional plan view showing an alternate configuration of the massage apparatus of FIGS. 1-3.
Figure 5:
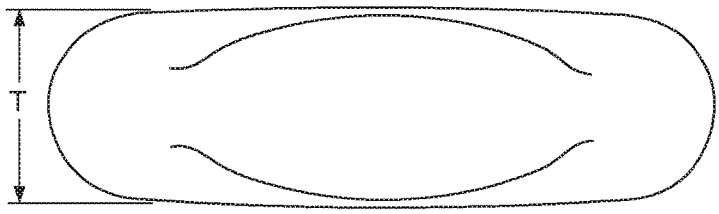
FIG. 5 is an end view of the massage apparatus of FIG. 4.

With further reference to FIGS. 4 and 5, an alternative configuration of the vibratory massager, designated 10', includes counterparts of the body, designated 11', the main body portion, designated 12", the handle portion, designated 13', the vibrator 14, the vibrating element section 15, the sleeve 16, the flexible arm portions 17, the casing, designated 18', the battery 20, the charging unit 22, the charging port 23, the control module 24, the button switch 26, the LED indicator 28, the cavity 36, and the insert member 38 as in the massager 10 of FIGS. 1-3. The housing 34 of the vibrator 14 is shown in further detail, having a motor end portion 34A and an opposite end portion 34B that fit together in a conventional manner. The motor 30 is conventionally suspended within the housing 34 by a plurality of locating ribs 31 that extend inwardly from the motor end portion 34A, and a plurality of retainer ribs 33 that similarly extend inwardly from the opposite end portion 34B.

Further shown in FIG. 4 are counterparts of the body, designated 11', and the main body portion, designated 12', a counterpart of the gap G separating the vibratory element section 15 from the main body portion 12", the body 11' being formed with a circular opening 40, creating a ring-shaped counterpart of the handle portion 13', of the main body portion 12'. The circular opening 40 can be used as a finger opening, or alternatively to be worn on a partner's penis to provide clitoral stimulation during intercourse. Accordingly, the circular opening 40 preferably has a diameter D of between 0.75 and 1.18 inch (20-30 mm). In an exemplary embodiment of the vibratory massage apparatus 10', the gap G measures approximately 0.67 inch (17 mm), the apparatus 10' having an overall length L of approximately 4 inches (102.6 mm), a width W of approximately 2.75 inches (70 mm) and a thickness T of 1.14 inch (30 mm).

Figure 6:
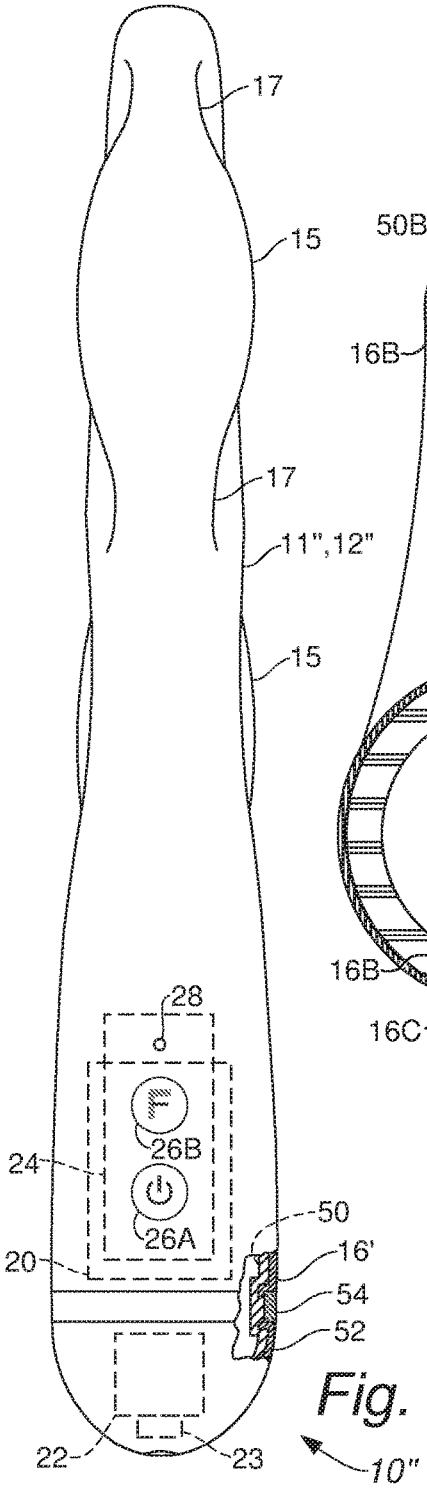
FIG. 6 is a top plan view showing another alternate configuration of the vibratory massage apparatus.
Figure 7:
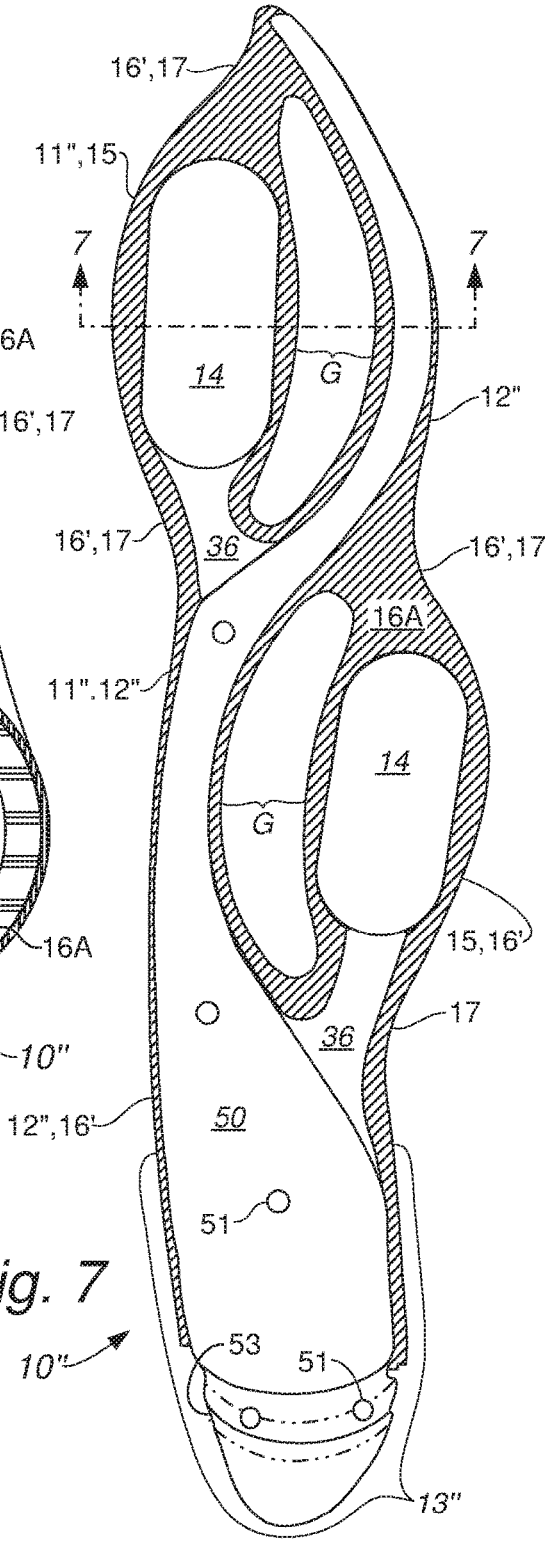
FIG. 7 is a fragmentary side sectional view of the vibratory massage apparatus of FIG. 5.

With further reference to FIGS. 6-8, another alternative configuration of the vibratory massager, designated 10", incorporates a counterpart of the body, designated 11", and two of the vibrators 14 axially displaced from opposite sides of a longitudinal backbone or spine member 50 that serves as a counterpart of the casing 18 of FIGS. 1-5. The spine member 50 thus defines the extent of a counterpart of the main body portion, designated 12". A counterpart of the sleeve, designated 16', covers each of the vibrators 14 and the spine member 50 and forms respective counterparts of the vibrating element section 15 and the main body 12", respective gaps G being formed in the sleeve 16', between each of the vibrating element sections 15 and the main body portion 12", the spine member 50 preferably having a sinuous shape as shown in FIGS. 6 and 7.

Respective pairs of the flexible arm portions 17 provide vibration isolation between the vibrators 14 and the main body 12". A counterpart of the cavity 36 extends between each of the vibrators 14 and the spine member 50 for providing a wiring channel between the vibrators 14 and a counterpart of the control module 24 and for enhanced flexibility between the vibrators 14 and the spine member 50. It will be understood that the present invention may incorporate vibrators 14 of different sizes, or only one vibrator 14.

The vibratory massage apparatus of FIGS. 6-8 also incorporates counterparts of the battery 20, the charging unit 22, the charging port 23, and the control module 24. Also, two counterparts of the button switch, power switch 26A and mode switch 26B are included in the exemplary configuration of FIGS. 6-8. The control module can be implemented to activate the massager in one of plural operating modes or patterns upon the power switch 26A being depressed for two seconds. Then the mode switch 26B can initiate additional patterns of operation in a conventional manner. Subsequently, the massager can be turned off by depressing the power switch 26A for two seconds. The battery 20 can be a conventional lithium battery, and the charging unit 22 can be a standard 5 volt USB charger. The control module 24 can be implemented to blink the LED 28 when charging. It will be understood that these details can be expressed in the massager configurations of FIGS. 1-5 as well.

With particular reference to FIG. 8, the sleeve 16' can be formed of opposite inner sleeve portions 16A and 16B and an outer sleeve portion 16C for facilitating assembly with the vibrators 14, the outer sleeve portion 16C securing the inner sleeve portions 16A and 16B about the vibrators 14 and at least a portion of the spine member 50 (or the casing 18 in the configurations of FIGS. 1-5). Alternatively, the outer sleeve portion 16C can be omitted, the inner sleeve portions being welded or otherwise joined by a suitable adhesive. As a further alternative, the sleeve 16' can be a single flexible member that encapsulates the vibrators 14 and at least a portion of the spine member 50. As indicated above, these alternatives can be applied to the configurations of FIGS. 1-5 as well. The spine member 50 is formed of opposite spine member portions 50A and 50B, being fastened together with suitable screws (not shown) at respective counterbore locations 51 as shown in FIG. 7. Although the spine member 50 could be formed as a unitary member, the preferred two-piece configuration described above facilitates assembly with the battery 20 and the control module 24, and avoids excessive material thickness of the spine member 50.

Advantageously, the vibratory massage apparatus 10" of FIGS. 6-8 can be used as a dildo, with the spine member 50 being manipulatable to press one of the vibrating element sections 15 into closer contact with the user's body, thereby intensifying stimulation felt by the user. Concurrently, a portion of the main body 12" opposite the other of the vibrating element sections 15 is more closely pressed against vaginal tissue. Thus the present invention concurrently provides both lateral pressure and localized vibratory stimuli, yet with the vibration power not being significantly transmitted to the spine member 50 which defines the extent of the main body 12".

Figures 9, 10:
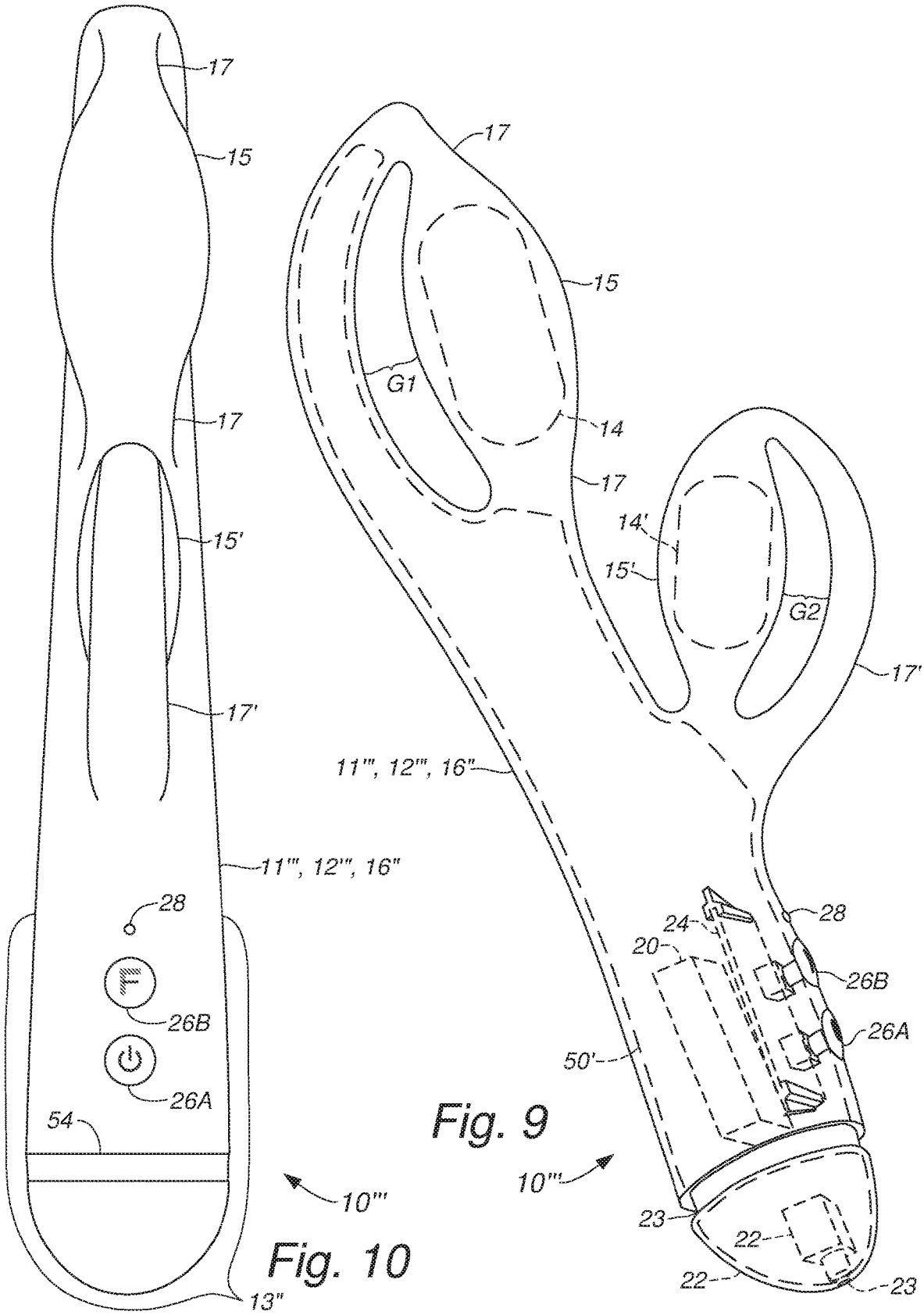
FIG. 9 is an oblique side perspective view showing an alternate configuration of the vibratory massager of FIG. 5.
FIG. 10 is a top plan view of the vibratory massager of FIG. 8.

With further reference to FIGS. 9 and 10, a further alternative configuration of the vibratory massager, designated 10'", corresponds to the configuration of FIGS. 5-7, but with one of the vibrators 14', and its associated vibrating element section, designated 15', being inclined or diverging from a similarly shaped spine member, designated 50'. As further shown in FIGS. 8 and 9, the vibrator 14' is smaller than the vibrator 14, and is located on the same side of the spine member 50' as the vibrator 14, and having a correspondingly smaller vibrating element section 15', there being respective gaps G1 and G2 between the vibrating element sections 15 and 15', respectively, the gap G2 being somewhat smaller than the gap G1. Also included in this exemplary configuration are counterparts of the body, designated 11''', the main body portion, designated 12''', the handle portion, designated 13'', the sleeve 16', the battery 20, the charging unit 22, the charging port 23, the control module 24, the power switch 26A, the mode switch 26B, the LED indicator 28, the cap 52, the groove 53, and the decorative ring 54. Counterparts of the flexible arm portions 17 flexibly support the vibrator 14 and one end of the vibrator 14', an elongated flexible arm portion, designated 17', supporting an opposite end of the vibrator 14'. The vibratory massager 10''' of FIGS. 9 and 10, when used as a dildo, provides both clitoral and vaginal vibratory stimulation with only insignificant vibration of the handle portion, designated 13''', thereof.

Although the present invention has been described in considerable detail with reference to certain preferred versions thereof, other versions are possible. For example, the massager can incorporate other types of vibrators such as those having oscillatory motors. Therefore, the spirit and scope of the appended claims should not necessarily be limited to the description of the preferred versions contained herein. All the equivalent transformations made by using the contents of the specification and the drawings of the present invention are directly or indirectly applied to the related technical fields, and are equally comprised within the scope of protection of the present invention.

What is claimed is:

1. A vibratory massage apparatus, comprising:

(a) a body member having a main portion and a handle portion that may overlap the main portion;

(b) a vibrator; and (c) vibration isolation means for resiliently supporting the vibrator relative to the main portion of the body member, comprising a plurality of flexible members connected between the vibrator and the main portion of the body member, the flexible members extending in different directions from the vibrator, wherein the body member comprises a flexible material, a vibrating element section of the body member at least partially enclosing the vibrator, flexible arm portions of the body member forming the flexible members.

2. The massage apparatus of claim 1 wherein a pair of the flexible arm portions extend oppositely from the vibrator.

3. The massage apparatus of claim 2 wherein the vibrator is elongate, wherein the pair of flexible arm portions extend from opposite ends of the vibrator.

4. The massage apparatus of claim 1 wherein the main portion and the vibrating element section of the body member are adapted for simultaneously contacting a user's anatomy.

5. The vibration massage apparatus of claim 1, further comprising:

(a) a casing enclosed within the body member and defining an extent of the main portion thereof; and (b) a control module, a battery, and a charging unit for the battery located inside the casing, the battery being connected for powering the vibrator and the control module, and the charging unit being adapted for receiving power from an external power source.

6. The vibration massage apparatus of claim 5, further comprising at least one control key located on the body within the handle portion thereof, the at least one control key being connected to the control module; at least one output control mode being stored in the control module; and the control module is configured for selectively activating or turning off the vibrator, and setting an output control mode in response to a user's control key operation.

7. The vibration massage apparatus of claim 1, wherein the handle portion of the body member has an opening extending therethrough for receiving a bodily appendage of the user or a partner of the user.

8. A vibratory massage apparatus comprising:

(a) a body member having a main portion and a handle portion that may overlap the main portion of the body member, the body member being formed of a flexible material;

(b) a spine member at least partially enclosed by the body member and extending within the handle portion;

(c) a vibrator at least partially enclosed by the body member; and (d) vibration isolation means for resiliently supporting the vibrator relative to the spine member such that portions of the body member enclosing the spine member and the vibrator are adapted for simultaneously contacting a user's anatomy, comprising a plurality of flexible members connected between the vibrator and the spine member, the flexible members extending in different directions from the vibrator, flexible arm portions of the body member forming the flexible members.

9. The massage apparatus of claim 8 wherein the vibrator is elongate, the flexible members extending in opposite directions from opposite ends of the vibrator.

10. The massage apparatus of claim 9 wherein the spine member is inflexible relative to the flexible members.

11. The massage apparatus of claim 10, wherein the vibrator is a first vibrator, the apparatus further comprising a second vibrator and corresponding flexible members connecting the second vibrator to the spine member.

12. The massage apparatus of claim 11, wherein the first and second vibrators are axially disposed along the spine member and oriented on opposite sides of the spine member.

13. The massage apparatus of claim 11 wherein the spine member is sinuous in shape.

14. The massage apparatus of claim 11 wherein the second vibrator is inclined relative to the spine member and on the same side thereof as the first vibrator.

15. The massage apparatus of claim 14 wherein the second vibrator is smaller than the first vibrator.

16. The vibration massage apparatus of claim 8, further comprising a control module, a battery, and a charging unit for the battery located inside the spine member, the battery being connected for powering the vibrator and the control module, and the charging unit being adapted for receiving power from an external power source.

17. The vibration massage apparatus of claim 16, further comprising at least one control key located on the body within the handle portion thereof, the at least one control key being connected to the control module; at least one output control mode being stored in the control module; and the control module is configured for selectively activating or turning off the vibrator, and setting an output control mode in response to a user's control key operation.

18. A method for massaging a user, comprising the steps of:

(a) providing (i) a body member having a main portion and a handle portion that may overlap the main portion; (ii) a vibrator; and (iii) vibration isolation means for resiliently supporting the vibrator relative to the main portion of the body member, the vibration isolation means comprising a plurality of flexible members connected between the vibrator and the main portion of the body member, the flexible members extending in different directions from the vibrator, wherein the body member comprises a flexible material, a vibrating element section thereof at least partially enclosing the vibrator, flexible arm portions thereof forming the flexible members;

(b) manipulating the vibrating element section of the vibrator into contact with an anatomy portion of the user;

(c) activating the vibrator; and (d) further manipulating the handle portion of the body member for varying contact pressure between the vibrating element section and the user's anatomy.

19. The method of claim 18, comprising the further step of manipulating the handle portion for simultaneously massaging a different anatomy portion of the user with the main portion of the body member.

20. The method of claim 19, comprising the further steps of:

(a) providing an opening through the handle portion of the body member; and (b) wherein the step of manipulating the handle portion comprises inserting a bodily appendage of the user or a partner of the user through the opening.

* * * * *